US006314862B1

(12) United States Patent
Retterer

(10) Patent No.: US 6,314,862 B1
(45) Date of Patent: Nov. 13, 2001

(54) COMBINATION CYLINDER AND PISTONS

(75) Inventor: John M. Retterer, Caledonia, OH (US)

(73) Assignee: Retterer Manufacturing Co., Inc., Caledonia, OH (US)

( * ) Notice: Subject to any disclaimer, the term of this patent is extended or adjusted under 35 U.S.C. 154(b) by 0 days.

(21) Appl. No.: 09/489,714

(22) Filed: Jan. 24, 2000

(51) Int. Cl.[7] ..... F01B 7/04; F01B 31/00
(52) U.S. Cl. ..... 92/62; 92/108
(58) Field of Search ..... 92/61, 62, 63, 92/107, 108, 110, 151

(56) References Cited

U.S. PATENT DOCUMENTS

| | | | | |
|---|---|---|---|---|
| 2,896,413 | * | 7/1959 | Hussey | 92/62 |
| 2,983,256 | * | 5/1961 | Seeloff | 92/110 |
| 3,053,294 | * | 9/1962 | Andersson | 92/106 X |
| 3,288,036 | | 11/1966 | Fisher | 92/62 |
| 3,385,172 | | 5/1968 | Kaminga . | |
| 3,430,539 | | 3/1969 | Freeman | 92/151 X |
| 3,457,840 | | 7/1969 | Grimes | 92/111 |
| 3,485,141 | | 12/1969 | Ott et al. | 92/151 X |
| 3,853,037 | * | 12/1974 | Denzler et al. | 91/440 |
| 3,880,051 | | 4/1975 | Eppler | 92/151 X |
| 3,968,735 | * | 7/1976 | Boisde et al. | 92/62 X |
| 4,005,598 | * | 2/1977 | Ehmann et al. | 91/461 X |
| 4,759,260 | * | 7/1988 | Lew | 92/152 X |
| 4,903,939 | * | 2/1990 | Ariizumi et al. | 251/63.4 |
| 5,191,825 | * | 3/1993 | Beneteau et al. | 92/62 X |
| 5,522,302 | * | 6/1996 | Yuda et al. | 92/151 X |
| 5,623,861 | * | 4/1997 | Ward et al. | 91/420 |

* cited by examiner

*Primary Examiner*—John E. Ryznic
(74) *Attorney, Agent, or Firm*—John L. Gray; Shawnell Williams

(57) ABSTRACT

A combination cylinder and pistons wherein the pistons are provided with piston rods coaxially located in the cylinder so that fluid under pressure may be introduced into the head of one of the pistons at one end of the cylinder and transmitted through a tubular opening coaxial with said piston rod to the space above the head of the next adjoining piston and if desired, through similar openings in a plurality of additional pistons, until the last piston rod which is not provided with such an opening therethrough and which is connected to a tool.

2 Claims, 2 Drawing Sheets

COMBINATION CYLINDER AND PISTONS

BACKGROUND OF THE INVENTION

Occasionally, it is desired to increase the piston rod output force in a cylinder while utilizing a single existing power source to the piston. Of particular interest is where the power source is a pneumatic or hydraulic power source. At the present time, this is accomplished by providing a power supply that is exterior to the cylinder body using multiple ports and exhausts mounted thereon. Control valves and manifolds are required in such a structure. Examples of this are shown in U.S. Pat. Nos. 3,288,036 Fisher and 3,880,051 Eppler. Such devices are complex and expensive. Furthermore, for applications such as handheld tools, the outside contour of such devices makes them inapplicable for such use due to external valving and piping. Also, equal force is not provided to all pistons simultaneously.

Attempts have been made to eliminate the complex control valves and manifolds but the results have been complex, expensive multi-piece designs where the pistons are all mounted on one rod and there is an internal manifold. Examples of these are U.S. Pat. Nos. 3,430,539 Freeman; 3,485,141 Ott, et al.; and 3,457,840 Grimes.

BRIEF SUMMARY OF THE INVENTION

Applicant's invention utilizes a plurality of pistons in a single cylinder where the pistons are axially aligned and wherein the actuating pressure is introduced to the cylinder head at one end and is transmitted through an opening in the piston rods to the cylinder head of the next piston and thus, repeatedly conducted through the piston rod of succeeding pistons until the last piston which is not so equipped and which is connected to the tool which is thus actuated by the movement of the pistons.

It is therefore an object of this invention to provide a simple, multiple piston, single cylinder device which may be readily adapted for use as a hand tool for multiplying the force from a single internal power supply.

This, together with other objects of the invention, will become apparent from the following detailed description of the invention and the accompanying drawings.

DETAILED DESCRIPTION OF THE INVENTION

Figure 1:
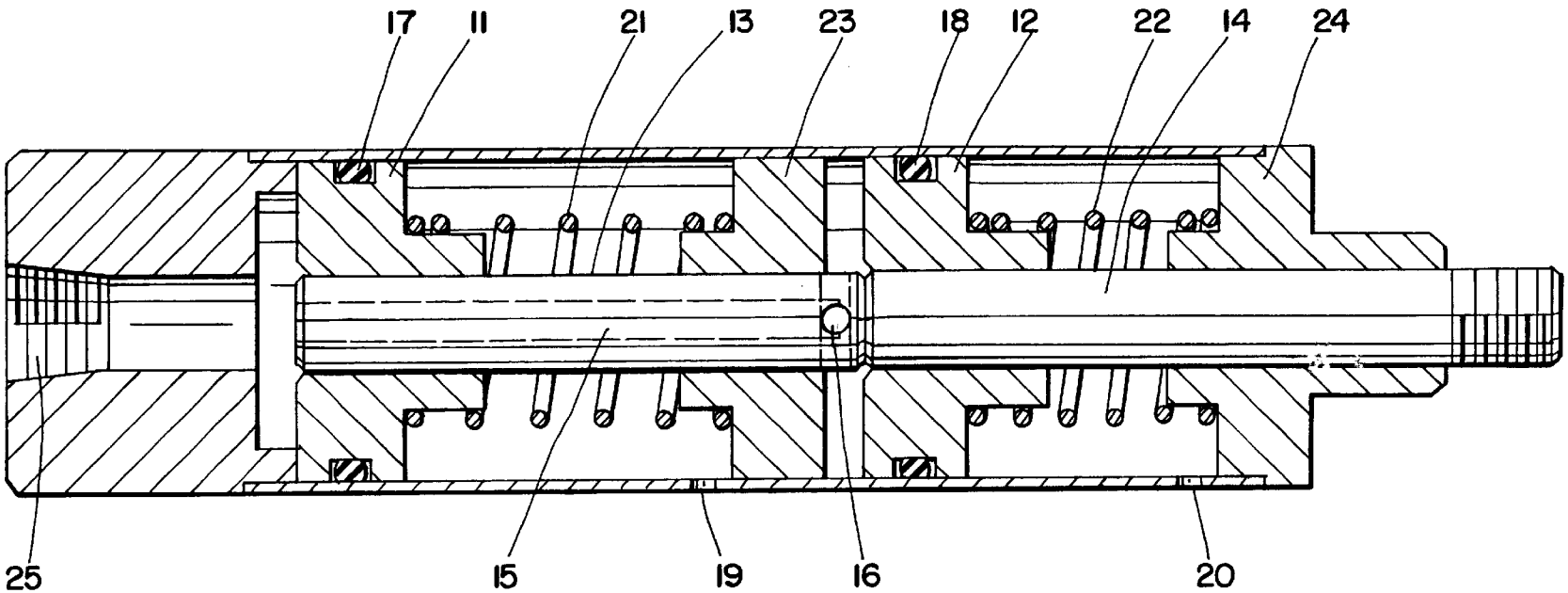
FIG. 1. Shows a stackable cylinder and two pistons, partly in section, with no actuating pressure and with one piston rod extending so as to be attached to a tool.

While this invention will be described with respect to a single cylinder containing two pistons, it is recognized that more than two pistons may be utilized Referring now to FIG. 1, the cylinder is shown at 10 with pistons 11 and 12 connected to piston rods 13 and 14 respectively. Piston rod 14 extends externally of the cylinder and is adapted to be connected to a tool. Piston rod 13 is provided with a hollow tubular portion 15 therein terminating in an opening 16 in the space above the piston 12. Piston rod 11 is provided with a gasket 17 extending there around and piston rod 12 is provided with a similar gasket 18 extending there around. Exhausts ports 19 and 20 are provided for pistons 11 and 12 respectively and springs 21 and 22 are provided to return the pistons to their normal position when pressure has not been applied to the piston heads. Spring 21 rests on base 23, which is firmly attached to the interior of the cylinder 10, providing a separate enclosed zone in said cylinder, and spring 22 rests on base 24, which also is firmly attached to the interior of cylinder 10, providing a separate enclosed zone in said cylinder. Pressure is applied to the piston heads through the opening 25.

Figure 2:
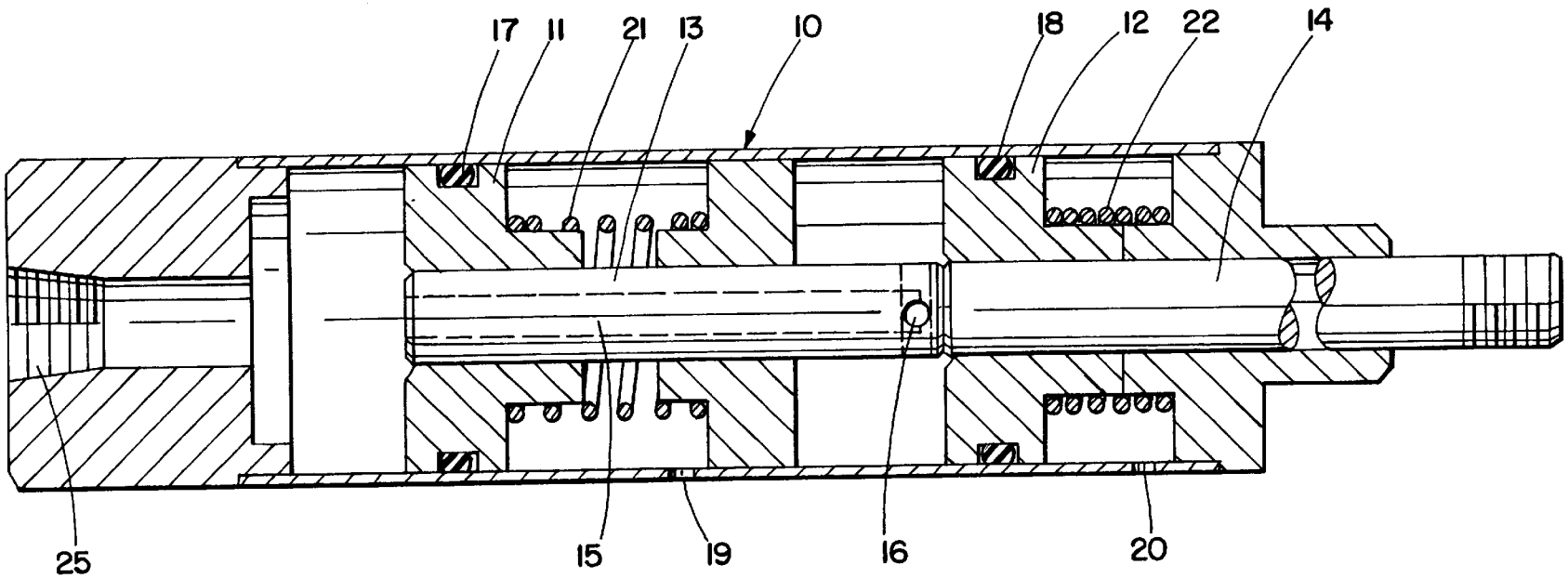
FIG. 2. Shows the same stackable cylinder and two pistons, partly in section, with the pistons compressed by actuating pressure.

Referring now to FIG. 2, the pistons have been moved by means of the introduction of pressure through opening 25, compressing springs 21 and 22 and moving the tool which is attached to piston 14. When the pressure at the entrance 25 is relieved, the pistons 11 and 12 will be returned to the positions shown in FIG. 1 by the springs 21 and 22 respectively.

It is to be understood that a number of pistons may be arranged inside a cylinder, each of which is equipped with an opening similar to the opening 15 and 16 in piston 13 as long as the piston comparable to piston 14, which is attached to the tool is not provided with such an opening. There is thus provided a simple hand-held unit which may be attached to a tool and which is easy to operate and maintain and wherein the piston rod output force may be increased merely be increasing the number of pistons in the cylinder.

While this invention has been shown and described with respect to detailed embodiments, it will be understood by those skilled in the art that various changes in form and detail thereof may be made without departing from the scope of the claimed invention.

What is claimed is:

1. A combination cylinder and pistons comprising a cylinder having a central axis a plurality of pistons in said cylinder and coaxial therewith, each of said pistons comprising a head and a fixed piston rod attached to said piston and coaxial with said cylinder, each of said piston rods being separate from said other piston rods and being unconnected to said other piston rods, each of said pistons being located in an enclosed zone of said cylinder each of said enclosed zones being provided with an opening axially positioned of a size to permit said piston rod to pass therethrough, each of said enclosed zones being provided with at least one exhaust port therein, one of said enclosed zones being provided with an opening above said piston head to permit the introduction of fluid under pressure into said enclosed zone, and the piston head and piston rod in said one of said enclosed zones being provided with a centrally disposed opening therethrough to permit fluid under pressure to pass therethrough and into the next adjacent enclosed zone above the head of the piston located in said next adjacent enclosed zone, each of said enclosed zones being provided with resilient means to return said piston therein to its position prior to the introduction of fluid under pressure into said enclosed zone.

2. The combination cylinder and pistons of claim 1 wherein said resilient means is a spring.

* * * * *